US005700158A

United States Patent [19]

Neiser et al.

[11] Patent Number: 5,700,158

[45] Date of Patent: Dec. 23, 1997

[54] CORD-REEL ASSEMBLY MOUNTED WITHIN A WALL

[76] Inventors: Gabe Neiser, 12 Gray Ave.; Theodore Simon, 35 Melrose Rd., both of Dix Hills, N.Y. 11746; Barry Schweiger, 9 Richborne La., Melville, N.Y. 11747

[21] Appl. No.: 611,370

[22] Filed: Mar. 6, 1996

[51] Int. Cl.[6] ..... H01R 13/72

[52] U.S. Cl. ..... 439/501; 439/652; 439/373

[58] Field of Search ..... 439/501, 4, 652, 439/373, 651, 536; 242/379; 200/51 R, 51.03, 51.05, 51.11

[56] References Cited

U.S. PATENT DOCUMENTS

| | | | |
|---|---|---|---|
| 3,013,105 | 12/1961 | Craig . | |
| 3,257,497 | 6/1966 | Chase . | |
| 3,815,078 | 6/1974 | Fedrick . | |
| 4,083,621 | 4/1978 | Davidson et al. . | |
| 4,647,735 | 3/1987 | Sicher | 200/43.08 |
| 4,653,833 | 3/1987 | Czubernat et al. | 242/96 |
| 5,138,351 | 8/1992 | Wiegand et al. | 439/501 |
| 5,236,371 | 8/1993 | Matthis | 439/501 |
| 5,562,488 | 10/1996 | Neiser et al. | 439/501 |

*Primary Examiner*—Gary F. Paumen
*Attorney, Agent, or Firm*—Collard & Roe, P.C.

[57] ABSTRACT

A cord-reel assembly mounted within a wall and powered by an in-wall electric power line or an adjacent wall socket. The cord-reel assembly includes a reel rotatably supported within a housing and an extension cord wound on the reel. An electrical socket is located on one end of the extension cord. The extension cord unwinds from the reel to position the electrical socket at locations remote from the housing. In alternate installations, a cover plate jointly covers the cord-reel assembly and the adjacent wall socket. The cover plate also electrically couples the cord reel assembly to the wall socket. Additional features such as an on/off switch, surge protection and surge indicator may also be provided on the cover plate.

10 Claims, 2 Drawing Sheets

CORD-REEL ASSEMBLY MOUNTED WITHIN A WALL

BACKGROUND OF THE INVENTION

1. Field of the Invention

The invention relates to a cord-reel assembly mounted within a wall. More particularly, it relates to a cord-reel assembly which can be newly installed instead of a conventional outlet or later installed adjacent a conventional wall outlet.

2. The Prior Art

Various devices of the prior art involve winding extension cords on rotary reels, whereby the extension cords can be pulled off the reel to supply electrical power to remotely-located appliances. Most of these devices are positioned a short distance from the power source, whereby a further extension cord is used to tap the power source. An attempt was made to develop a more compact cord-reel assembly by mounting them directly onto a wall outlet. Certain cord-reel assemblies mounted on a wall outlet are disclosed in U.S. Pat. No. 3,815,078 and U.S. Pat. No. 5,236,371. However, a major drawback still exists with these patented cord-reel assemblies in that they continue to occupy a large volume of space adjacent the wall outlet. In addition, because they are primarily supported by the plug of the cord-reel assembly, the prior art devices are subject to being disconnected when the extension cord is pulled to unwind it from the reel, unless further secured, i.e. by a retaining screw.

SUMMARY OF THE INVENTION

It is therefore an object of the present invention to provide a cord-reel assembly, which is substantially flush mounted to or in the wall or within the wall cavity.

It is a further object of the present invention to provide a cord-reel assembly which can be readily installed adjacent a conventional, existing wall outlet or as a stand-alone cord-reel outlet assembly.

These and other related objects are achieved according to the invention by an apparatus electrically coupled to a wall socket mounted within a wall having an outlet. The apparatus includes a cord-reel assembly adapted for mounting within the wall adjacent the wall socket or by itself and which includes a retractable extension cord with an accessible electrical socket on one end of the extension cord. A cover plate jointly and at least partially covers the cord-reel assembly and the wall socket, and an electrically couples the cord-reel assembly to the wall socket.

The cover plate completely covers the wall socket and includes at least one replacement outlet. The cover plate comprises a first plug for plugging into the outlet of the wall socket a second plug electrically connected to the first plug for plugging into the cord-reel assembly to power the extension cord. The cord-reel assembly includes a recessed outlet for engaging the second plug, and the cover plate includes a raised platform behind the second plug having a shape corresponding to the shape of the recess. The raised platform and the recess are matingly engaged to support the cord-reel assembly. The cord-reel assembly includes a reel rotatable around a central axis which is disposed perpendicular to the wall with the extension cord extending off the reel and turning approximately 90° to pass through the cover plate.

The cover plate comprises an electrical surge protector and a multi-position switch connected in series between the first plug and the second plug. The cover plate also comprises a first visual indicator for signaling operation of the electrical surge protector and a second visual indicator for indicating a position of the switch. The cover plate further comprises two telephone jacks and an electrical surge protector serially coupled between the two telephone jacks.

Alternatively, the cord reel assembly is mounted within a wall for connection to an in-wall electrical power line. The cord-reel assembly includes a housing adapted for installation within the wall, a reel rotatably supported within the housing, an extension cord wound on the reel, and an accessible electrical socket on one end of the extension cord. The extension cord is adapted to unwind from the reel to position the electrical socket at locations remote from the housing. A further accessible electrical socket is mounted to the housing and connected in parallel with the accessible electrical socket.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
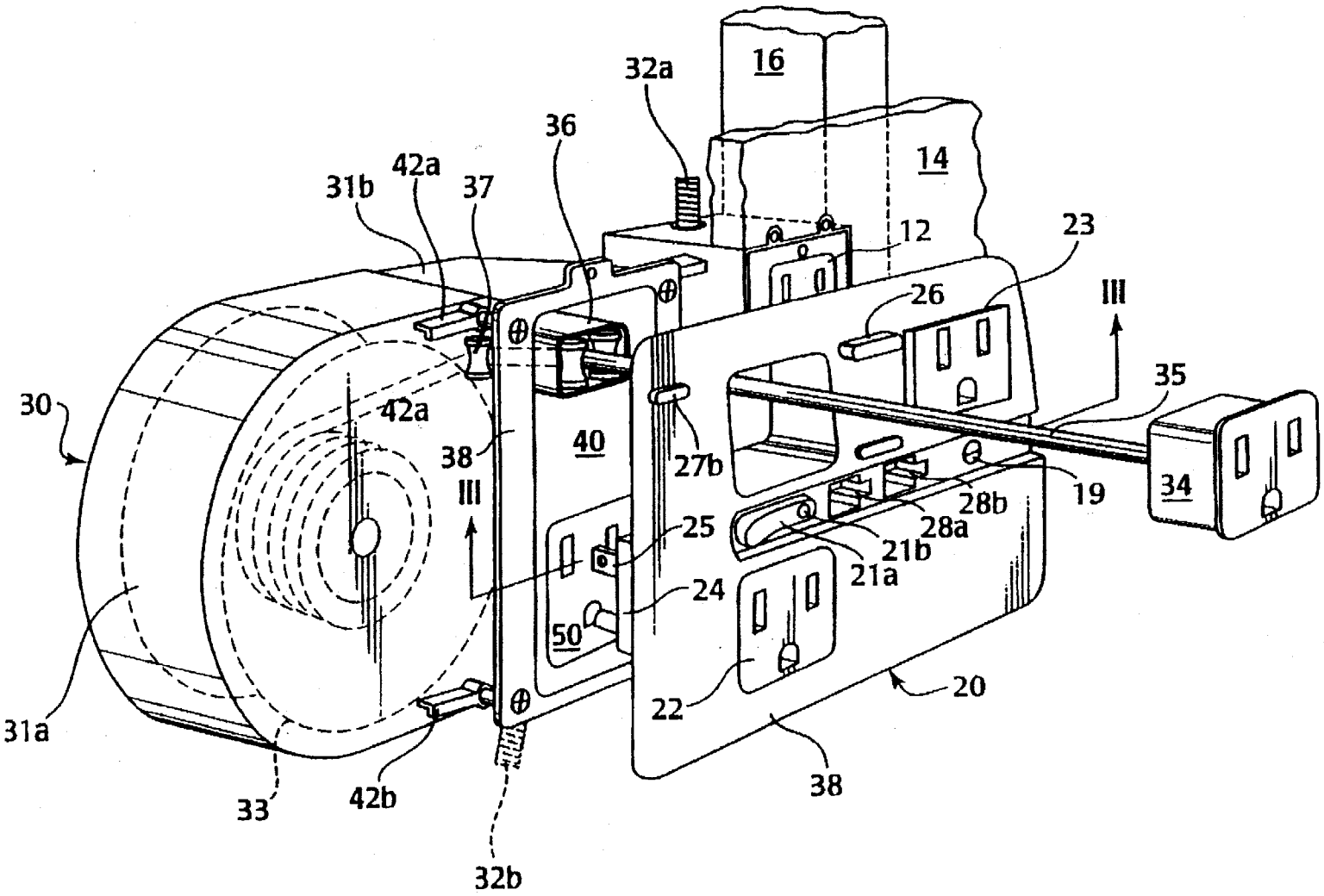
FIG. 1 is a perspective view of a cord-reel assembly and cover plate according to the invention.

Referring now in detail to the drawings and, in particular FIG. 1, there is shown a first embodiment of a cord-reel assembly 30, which is mounted within a wall 14 adjacent a standard in-wall duplex outlet 12. However, any type of existing outlet may be used. A cover plate 20 jointly covers the exposed portions of duplex outlet 20 and reel assembly 30. While one particular embodiment of cover plate 20 is shown in FIG. 1, alternate embodiments are possible in connection with alternate electrical wiring configurations, which will be discussed in greater detail below.

Reel assembly 30 includes a cylindrical reel housing **31*a* which rotatably supports a reel 33 onto which is wound an extension cord 35. Reel 33 rotates around a central axis which is perpendicular to the planar surface of wall 14 when reel assembly 30 is properly installed. Extension cord 35 extends off of reel 33 through transfer housing 31*b* where it makes an approximately 90° turn around a guiding roller 37. Extension cord 35 then passes between a pair of pinch rollers 36 before passing through wall 14 and then cover plate 20 where it is accessible for use. At the free end of extension cord 35, a grounded or ungrounded electrical socket 34** is provided.

The extension and retraction of extension cord 35 may operate according to various releasible locking systems, which are well known in the art. For example, reel 33 may have an internal locking mechanism, which allows retraction of the extended cord by pulling out slightly on the cord. This type of operation is similar to cord reel assemblies on vacuum cleaners, for example. Alternatively, pinch rollers 36, rotatably mounted to transfer housing **31*b*, are slightly offset from each other and biased toward each other against extension cord 35 to pinch and hold extension cord 35 in a particular position against a continuous retracting force exerted by reel 33. A push button 26 may be provided on cover plate 20 which separates pinch rollers 36 to relieve tension on extension cord 35 allowing it to be retracted onto reel 33**.

Reel assembly 30 may be installed and powered in various configurations. For example, in new construction, a power supply **32*b* enters transfer housing 31*b* through a conventional knock out where it is connected in parallel to extension cord 35 and outlet 50. Transfer housing 31*b* is then attached to a vertical supporting beam 16 just like a conventional junction box. An alternate installation for new construction requires transfer housing 31*b* to be ganged to a standard junction box which is attached to vertical supporting beam 16. The standard junction box is wired in the conventional way with a power supply line extending through into transfer housing 31*b* to power extension cord 35 and outlet 50**. After the electrical connections are made and the junction boxes are secure, the wall is installed.

For these new construction installations where reel assembly 30 is powered directly from an in-wall power supply **32*a* or 32*b*, cover plate 20 may be a different design than shown in FIG. 1. An aperture would still be provided within cover plate 20 to accommodate electrical socket 34. In addition, the cover plate may be secured with a screw to a threaded hole in surface 40, as with conventional cover plates. Finally, a second lower aperture might be provided to access outlet 50**.

Figure 3:
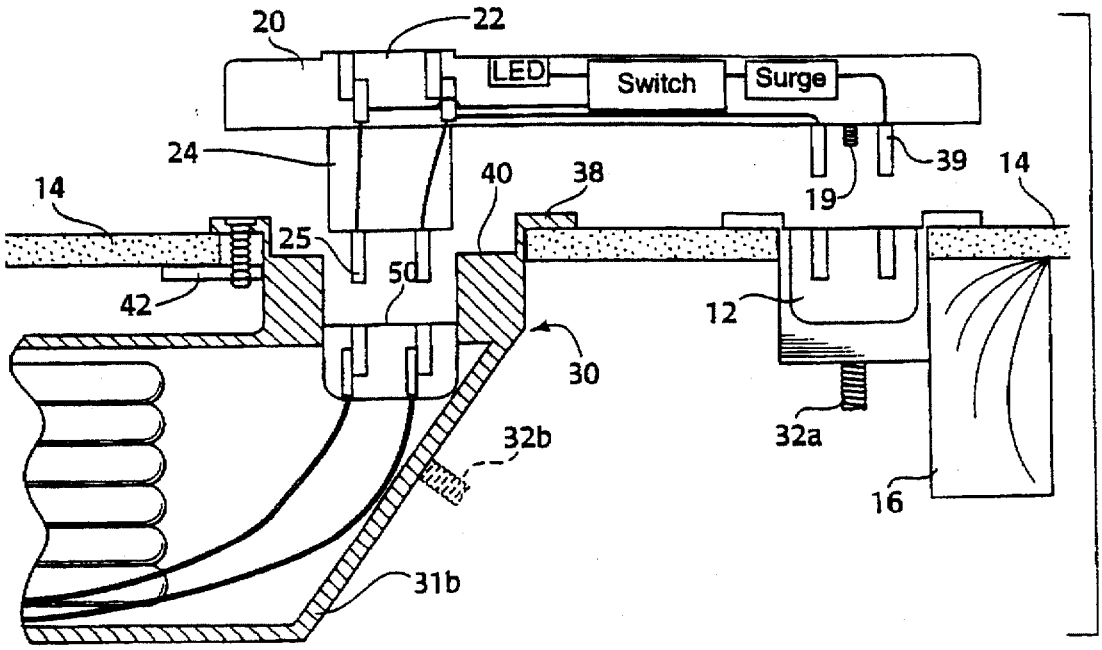
FIG. 3 is a cross-sectional view taken along the line III—III from FIG. 1.

As seen in FIGS. 1 and 3, in the installation for existing construction, a reel assembly 30 is installed within the wall adjacent a standard in-wall outlet 12. Typically, a quad or a duplex outlet 12 resides within a junction box which is secured to a vertical supporting beam or stud 16. On the side of outlet 12 opposite stud 16, a cutout is made, for example in a sheetrock wall 14, slightly spaced from outlet 12. The hole would be approximately the same size as would be required to install a duplex junction box into existing construction. Reel housing **31*a* is slipped through the hole and then rotated counter clockwise until a face plate 38 is flushed against the front surface of wall 14. Screws are screwed through top and bottom screw holes into wall 14. Secure tabs 42*a* and 42*b* are then rotated one-quarter to one-half turn to sandwich the wall between themselves and face plate 38. Reel assembly 30 is further stabilized by cover plate 20, and more particularly platform 24 which engages a recess in front of an outlet 50 and plug blades 25 which engage outlet 50. For example, platform 24 and the recess is front of outlet 40 have corresponding rectangular shapes adapted to be matingly engaged. In addition, another plug 39 and a screw 19 extend out the rear of cover plate 20 to outlet 12**.

Figure 2:
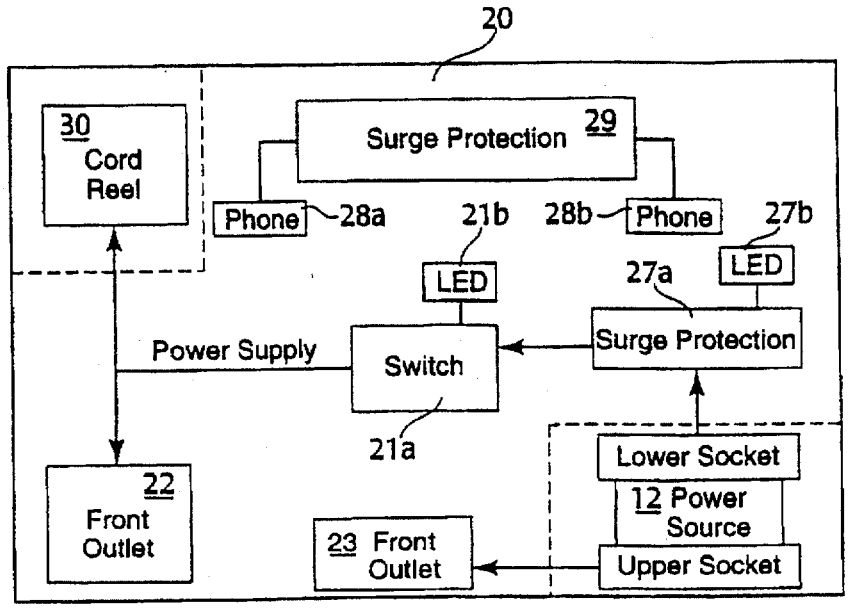
FIG. 2 is a schematic diagram showing the electrical connections within the cover plate.

In addition to contributing to the support of reel assembly 30, cover plate 20 may also provide power to outlets 22, 23 and 34, as shown in FIGS. 2 and 3. Because cover plate 20 has a slightly greater depth than standard cover plates, a duplicate outlet 23 is provided directly in front of and powered by the upper socket on duplex outlet 12. Plug 39, which is connected to the lower socket of duplex outlet 12, is then coupled to an electrical surge protector **27*a*, which includes a visual indicator or LED 27*b* to indicate operation of surge protector 27*a*. Switch 21*a* is then electrically connected to surge protector 27*a*, along with a visual indicator or LED 21*b* to indicate when switch 21 is in the on position, for example. Downstream of switch 21*a* power is provided to replacement outlet 22 and plug 25, which provides power to recessed outlet 50, which is electrically coupled with extension cord 35. As can be most easily seen in FIG. 3, outlet 22 is positioned directly in front of plug 25. Since sufficient depth must be provided for these two structures, cover plate 20** is several times thicker than a conventional decorative cover plate. For quad or larger outlets, a wider cover plate would be provided.

Cover plate 20 may also include a pair of telephone jacks **28*a* and 28*b* which are connected together through a surge protector 29. A telephone or modem installed in the vicinity of cover plate 20 can be plugged into telephone jack 28*b* with the incoming phone line connected to telephone jack 28*a*** to provide surge protection for the telephone or modem.

Accordingly, while only several embodiments of the present invention have been shown and described, it is obvious that many changes and modifications may be made thereunto without departing from the spirit and scope of the invention.

What is claimed is:

1. An apparatus for electrically coupling to a wall socket mounted within a wall and having an outlet comprising:

a cord-reel assembly adapted for mounting within the wall adjacent the wall socket and including a retractable extension cord with an accessible electrical socket on one end of said extension cord; and cover plate means adapted for jointly and at least partially covering said cord-reel assembly and the wall socket and adapted for electrically coupling said cord-reel assembly to the wall socket.

2. The apparatus according to claim 1, wherein said cover plate means is adapted to completely cover the wall socket and includes at least one replacement outlet.

3. The apparatus according to claim 2, wherein said cover plate means comprises:

a first plug adapted for plugging into the outlet of the wall socket; and a second plug electrically connected to said first plug adapted for plugging into said cord-reel assembly to power said extension cord.

4. The apparatus according to claim 3, wherein said cord-reel assembly includes a recessed outlet for engaging said second plug, and said cover plate means includes a raised platform behind said second plug having a shape corresponding to the shape of the recess, wherein said raised platform is adapted for matingly engaging the recess to support said cord-reel assembly.

5. The apparatus according to claim 4, wherein said cord-reel assembly includes a reel rotatable around a central axis, wherein the central axis is disposed perpendicular to the wall with said extension cord extending off said reel and turning approximately 90° to pass through said cover plate means.

6. The apparatus according to claim 3, wherein said cover plate means comprises an electrical surge protector and a multi-position switch connected in series between said first plug and said second plug.

7. The apparatus according to claim 6, wherein said cover plate means comprises a first visual indicator for signaling operation of said electrical surge protector and a second visual indicator for indicating a position of said switch.

8. The apparatus according to claim 6, wherein said cover plate means comprises two telephone jacks and an electrical surge protector serially coupled between said two telephone jacks.

9. An apparatus for mounting within a wall for connection to an in-wall electrical power line comprising:

a cord-reel assembly including a housing adapted for installation within the wall, a reel rotatably supported within said housing, an extension cord wound on said reel, an accessible electrical socket on one end of said extension cord, means for directly connecting said cord-reel assembly to an in-wall electrical power line, and cover plate means for at least partially covering said cord reel assembly, said cover plate means having an aperture to accommodate said electrical socket;

whereby said extension cord is adapted to unwind from said reel to position said electrical socket at locations remote from said housing.

10. The apparatus according to claim 9, comprising a further electrical socket mounted to said housing and connected in parallel with said accessible electrical socket, and further comprising a second aperture in said cover plate means for providing access to said further electrical socket.

* * * * *